United States Patent [19]

Trickel

[11] 4,228,998

[45] Oct. 21, 1980

[54] BRAKING APPARATUS FOR DOG TRACK RABBIT LURE CAR

[76] Inventor: Lorn L. Trickel, 8806 NE. Thompson St., Portland, Oreg. 97220

[21] Appl. No.: 964,950

[22] Filed: Nov. 30, 1978

[51] Int. Cl.[3] ..... A63K 1/02; A63K 3/00

[52] U.S. Cl. ..... 272/4; 104/249; 188/44; 188/62

[58] Field of Search ..... 272/4; 104/89, 94, 139, 104/26 A, 140, 250, 251, 249, 257; 188/62, 44

[56] References Cited

U.S. PATENT DOCUMENTS

| | | | |
|---|---|---|---|
| 1,281,594 | 10/1918 | Lehman et al. | 188/62 |
| 1,827,162 | 10/1931 | Miller | 188/62 |
| 1,961,998 | 6/1934 | Bacon | 188/62 |
| 2,197,446 | 4/1940 | Alldritt | 272/4 |
| 2,204,102 | 6/1940 | Hayden | 104/251 |
| 3,519,107 | 7/1970 | Bellinger | 188/62 |

*Primary Examiner*—Richard T. Stouffer
*Attorney, Agent, or Firm*—Eugene D. Farley

[57] ABSTRACT

The braking apparatus of this invention functions in cooperation with a rabbit lure car provided with longitudinally arranged brake shoes adapted to be clamped between elongated clamp members as the lure car passes the clamp members. Actuation of the clamp members is by a fluid cylinder, preferably pneumatic, lever-connected to an actuating rod that operates through a plurality of bell cranks to open and close the elongated clamps. The clamp opening is positioned in pre-set spacing when the operator transfers a control switch preparatory to the lure car's entering the vicinity of the clamp members. When the lure car passes a preestablished position following initial braking resulting from the pre-set clamp spacing, full clamp pressure is automatically applied, stopping the lure car.

An associated fluid cylinder automatically opens a lure gate when the lure operator transfers the control switch to pre-set the clamp spacing. Transfer of the control switch to its initial position releases the clamp members and closes the lure gate.

Emergency apparatus is provided for opening the lure gate and clamping the clamp members in the event the normally automatic system fails.

5 Claims, 8 Drawing Figures

BRAKING APPARATUS FOR DOG TRACK RABBIT LURE CAR

BACKGROUND AND GENERAL STATEMENT OF THE INVENTION

My invention pertains to apparatus for control of the operations associated with the rabbit lure car at the conclusion of a dog race.

Existing apparatus used in conjunction with the dog track rabbit lure car for braking control of the lure car at the conclusion of each race and for protection of the rabbit lure requires manual operation by a special operator positioned at the stopping point of the lure car. The special operator requires instruction from the lure car operator, who is located at the top of the grandstand or other remote place, over a speaker system which operates unsatisfactorily because of the dog track noise.

Union rules may require that the operator be electrically trained, or have an electrically trained assistant. Also, the actual time required for controlling and stopping the lure car at the completion of the dog race represents only a small percentage of the total operator time available. These two factors result in a high cost for the performance of this relatively simple control function.

It is the general object of the present invention to provide braking apparatus that will permit the lure car operator to initiate the functions associated with the stopping of the lure car from his remote operating position and to provide automatic stopping of the lure car and protection of the lure car rabbit, thereby eliminating the need for manual performance of these functions by a special operator.

Another object of this invention is to provide braking apparatus that will afford complete braking control of the rabbit lure car by the lure car operator.

Another object of this invention is to provide braking apparatus that will assure protection of the lure car and the rabbit lure.

Another object of this invention is to provide braking apparatus that assures maximum safety in the operation of the lure car.

Another object of this invention is to provide braking apparatus that is simple in construction and low in maintenance cost.

Another object of this invention is to provide braking apparatus that is applicable to existing lure car installations with a minimum of modification.

Another object of this invention is to provide braking apparatus that will indicate to the lure car operator that the apparatus is ready to perform its function.

Another object of this invention is to provide emergency braking apparatus to assure control of the lure car and rabbit protection in the event of failure of the primary control apparatus.

Broadly considered, the foregoing and other objects of this invention are accomplished using a lure car provided with longitudinally arranged brake shoes, by braking apparatus comprising a pair of laterally spaced elongated clamp members positioned between the lure car tracks and adapted to clamp the lure car brake shoes. The clamping and unclamping of the laterally spaced clamp members is by a plurality of bell cranks and linkages. The bell cranks are spring connected to a rod substantially parallel to and spaced from the clamp members. The rod is connected to a lever driven by a fluid, preferably pneumatic, cylinder. Energizing the fluid cylinder pre-sets the clamp members to a spacing that will produce an initial braking of the lure car. Final braking occurs when the lure car actuates a limit switch causing the fluid cylinder to apply additional clamping of the brake shoes and stopping the lure car at its designated position.

For rabbit protection a pivotally mounted lure gate contoured to the racetrack curvature is opened and closed by a fluid cylinder operating in conjunction with the lure car braking cylinder to permit withdrawal of the rabbit lure from the track and to separate it from the race dogs.

BRIEF DESCRIPTION OF THE DRAWINGS AND DESCRIPTION OF THE APPARATUS

Figure 1:
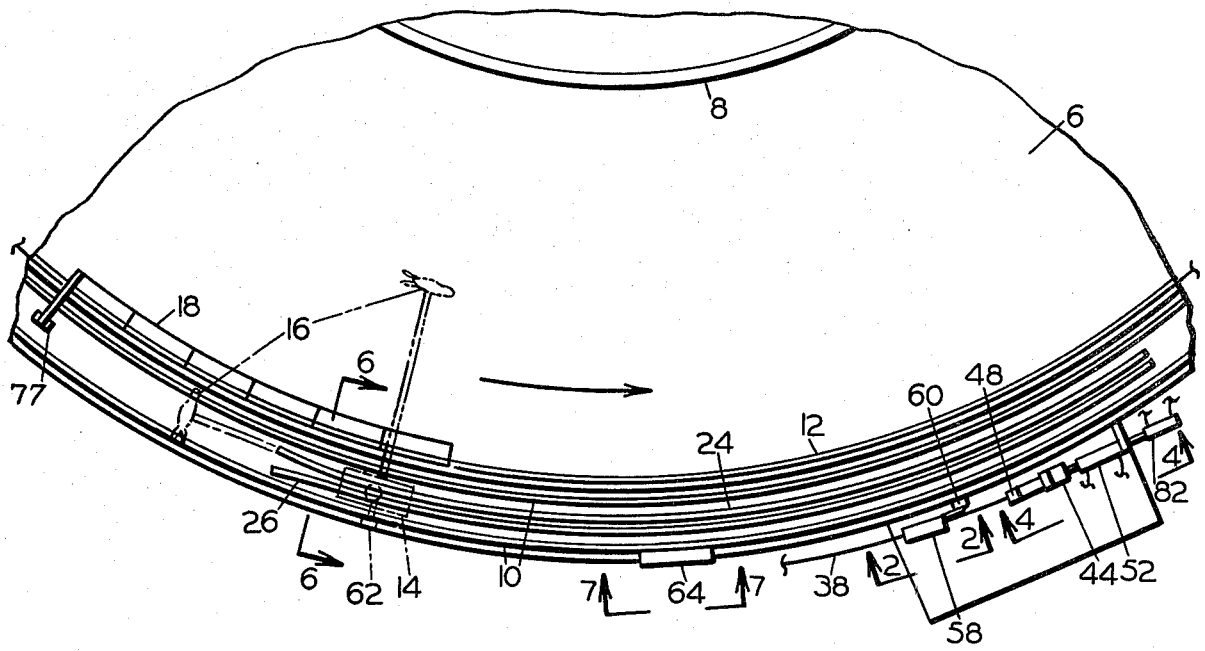
FIG. 1 is a fragmented and diagrammatic plan view of the circular end of a dog race track with the lure car at the position of rabbit withdrawal.

The dog track 6, FIG. 1, is in the form of an obround surrounding a pole 8. Surrounding the outer edge of the track are lure car rails 10 separated from the track by wall 12 and supporting the lure car 14 which transports the rabbit lure 16. Positioned in the first half of the curve following the finish line of the track is a lure gate 18 and the associated apparatus for swinging rabbit lure 16 outside track 6 and for braking lure car 14, FIG. 1.

A conventional lure car 14 is supported on rails 10 by four driven flanged wheels 20. It is provided with a downwardly projecting longitudinal fin 22, FIG. 6. Fin 22 is vertical on one face and sloped on the opposite face. Both faces are provided with brake shoes **22*a*** of friction material.

Figure 6:
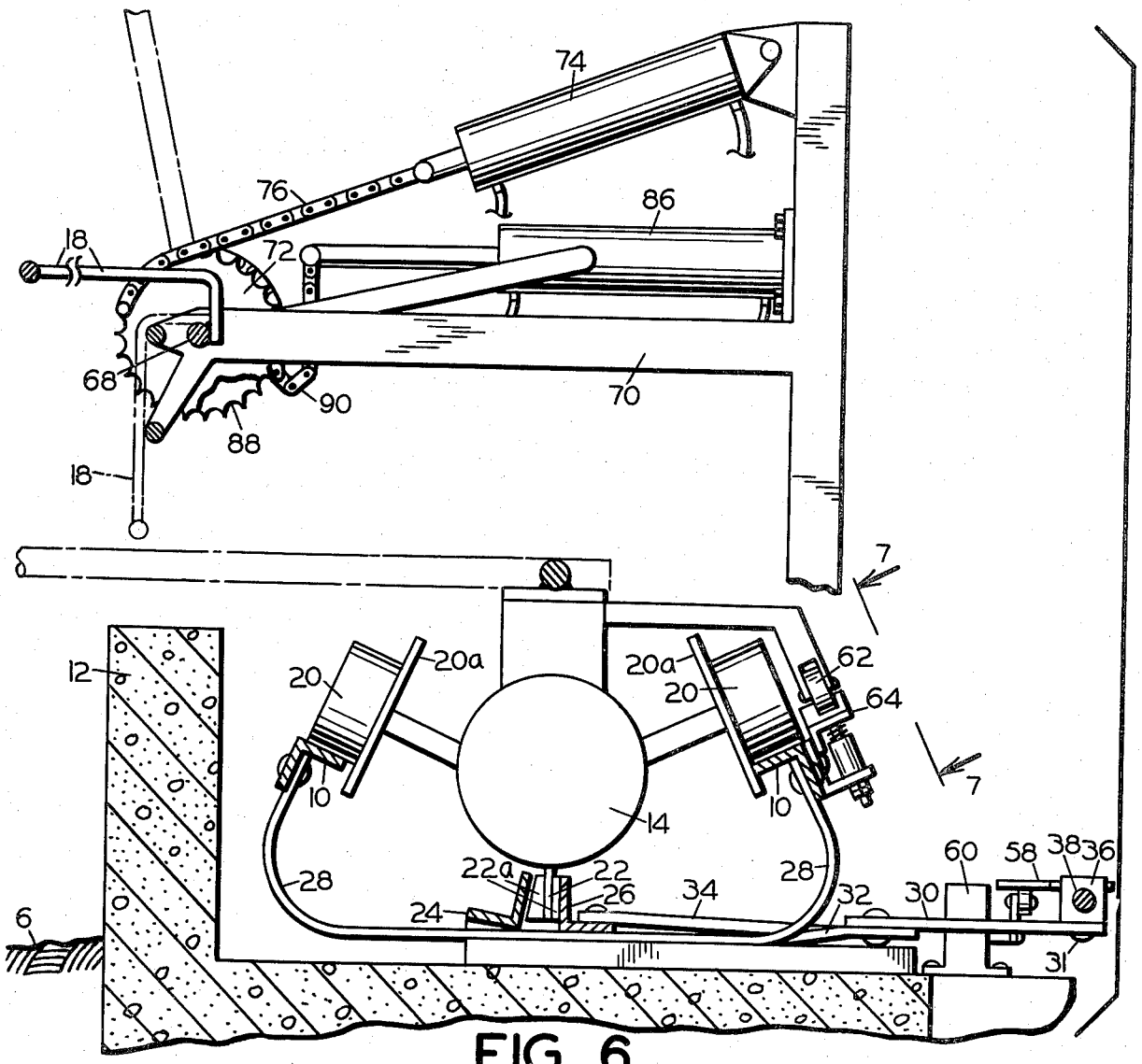
FIG. 6 is a cross-section elevational view along the line 6—6 of FIG. 1.

Positioned between rails 10 and below lure car 14 are elongated angle iron clamp members 24 and 26, FIGS. 1, 3 and 6. Clamp member 24 is fixed in position relative to rails 10 and is set on an angle corresponding to the sloping side of fin 22. Clamp member 26 is mounted to slide transversely on rail supports 28 to permit engagement of the longitudinal brake shoes **22*a* by the clamp members 24 and 26. The longitudinal position of clamp member 26 is maintained by lugs 26*a*, 26*b***.

Clamp members 24 and 26 extend around the arc of the lure car track a distance sufficient to brake the lure car as the clamp members are forced against brake shoes **22*a*. Clearance between flanges 20*a* of lure car wheels 20 and rails 10 permits the lure car to move transversely as is required to accomplish the clamping action without binding of the flanges against rail 10**.

Figure 3:
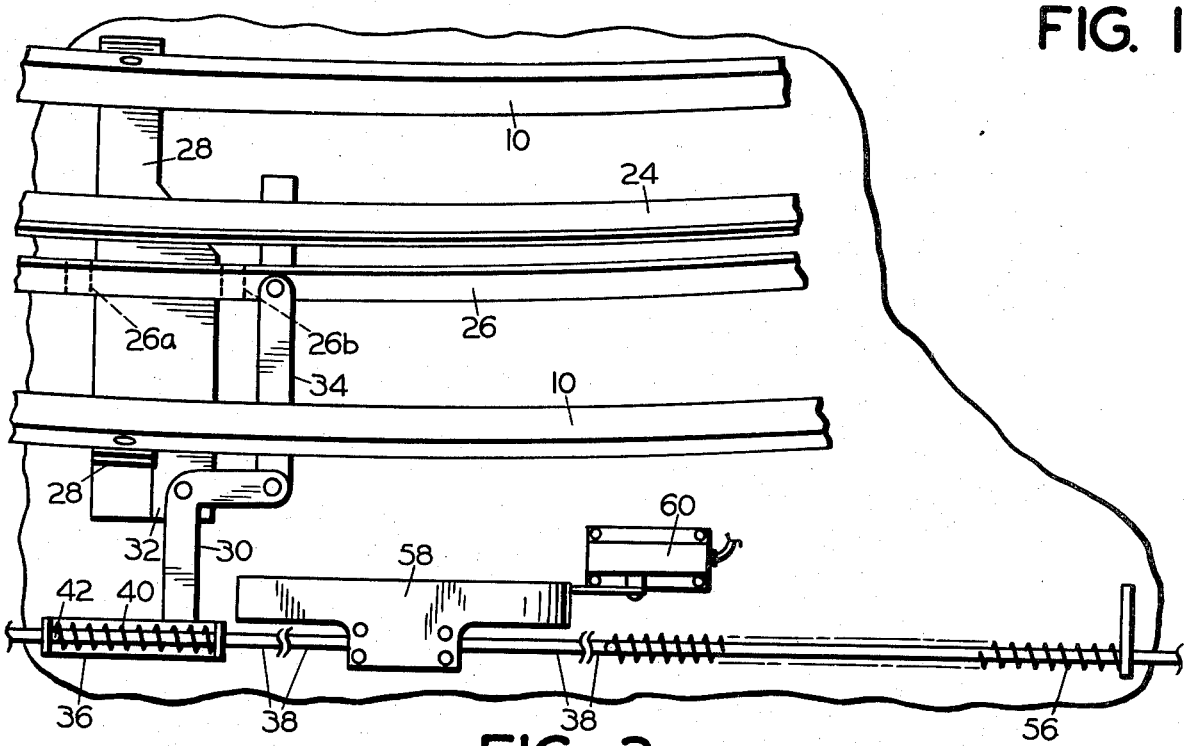
FIG. 3 is a fragmented plan view taken along line 3—3 of FIG. 2, showing the lure car track, the clamp members and the linkage.
Figure 2:
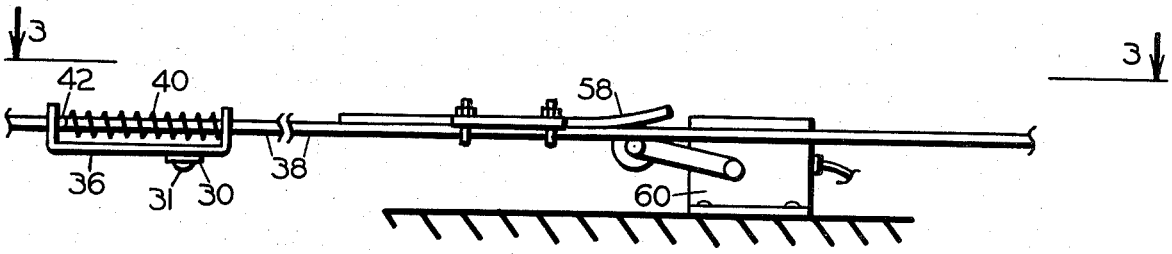
FIG. 2 is an elevational view of the clamp member and limit switch arrangement viewed along the line 2—2 of FIG. 1.

Spacing of clamp members 24 and 26 and movement of clamp member 26 relative to clamp member 24 is accomplished by a plurality of bell cranks 30, FIGS. 3 and 6, mounted on brackets 32 and pivotally joined to clamp member 26 by links 34. The outer end of each bell crank 30 is pivotally connected by a pin 31 to a U-shaped yoke 36 slidably mounted on rod 38, FIG. 2. Each yoke 36 is retained in longitudinal position on rod 38 by a spring 40 which forces the yoke against a transverse pin 42 carried by the rod.

Longitudinal movement of rod 38 positions the spacing of clamp member 26 relative to clamp member 24 causing the clamp members to clamp the brake shoes 22*a*. The clamping pressure is established by the amount longitudinal movement of rod 38 compresses springs 40.

This arrangement permits pre-setting the spacing of the clamp members so that as the lure car brake shoes first enter between the clamp members, clamp members are spread, compressing spring 40 and applying a pre-set preliminary clamping pressure. Further longitudinal movement of rod 38 increases the clamping pressure to accomplish the final braking.

Figure 5:
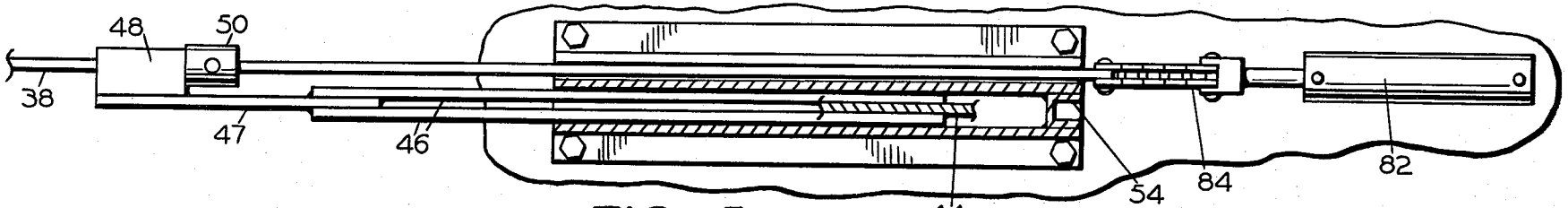
FIG. 5 is a sectional view taken along line 5—5 of FIG. 4.
Figure 4:
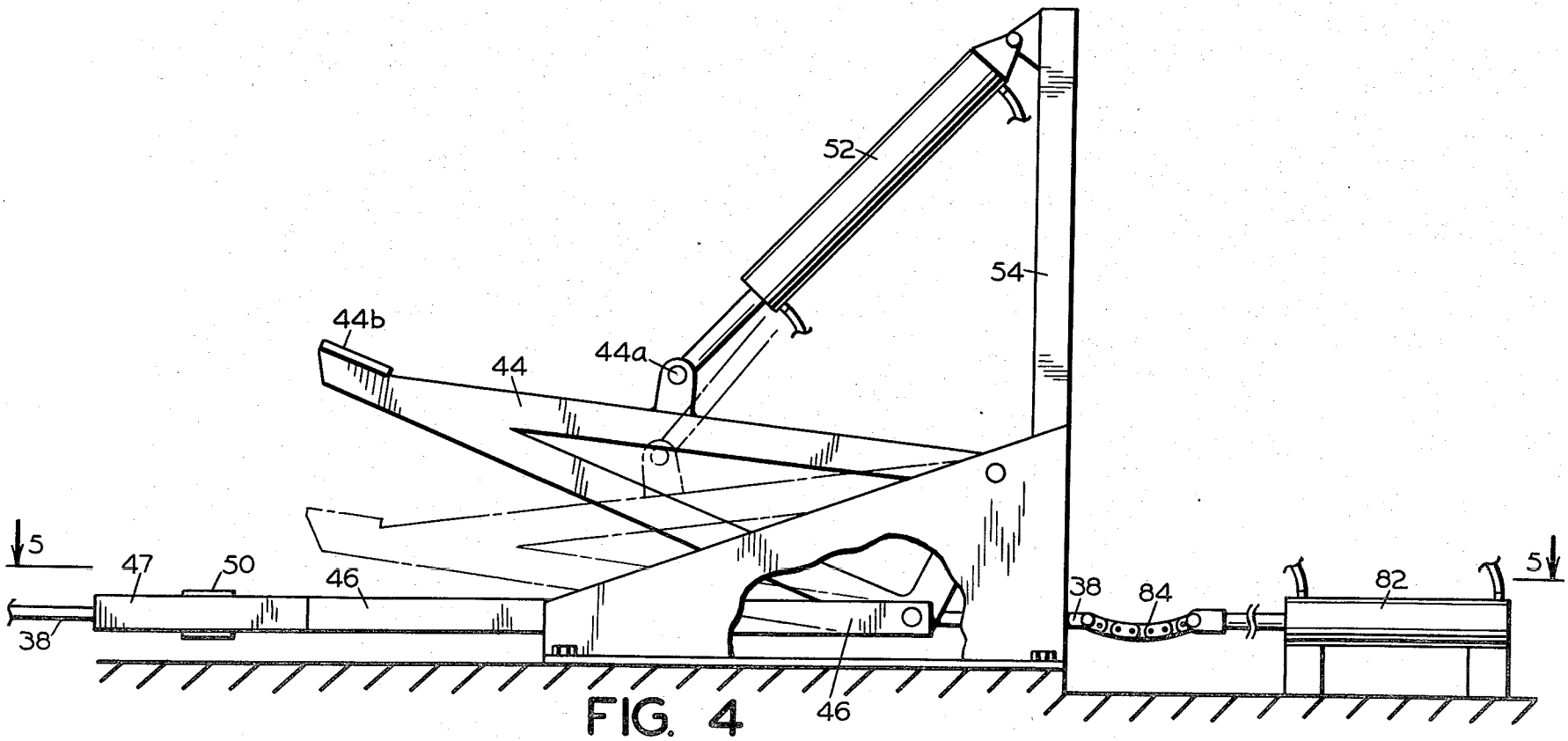
FIG. 4 is an elevational view of the clamp member drive linkage along the line 4—4 of FIG. 1.

Longitudinal movement of rod 38 is provided by a pivot-mounted, triangular shaped lever 44, FIGS. 4 and 5, connected to parallel links 46 that are in turn joined by bar 47 to sliding block 48 adapted to slide rod 38. Fixed to rod 38 is block 50 adapted to be contacted by the sliding block 48 as lever 44 is moved downward thereby shifting rod 38 longitudinally and closing the spacing of clamp members 24 and 26.

Fluid cylinder 52 pivotally connected between the lever 44 and frame 54 drives lever 44. If desired, manual operation of lever 44 is provided by removing pivot pin 44*a* and using foot pedal 44*b* to move rod 38 longitudinally. Raising lever 44 moves sliding block 48 free of fixed block 50, permitting springs 56 spaced along rod 38 to return rod 38 to unclamp the clamp members 24 and 26.

Figure 7:
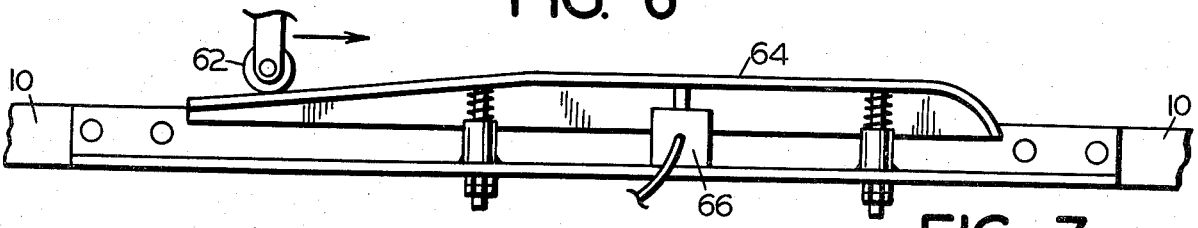
FIG. 7 is an elevation view along the line 7—7 of FIGS. 1 and 6.

Mounted on the lure car 14 and extending over the rail 10 is a roller 62, FIG. 7 adapted or engage a spring-supported, vertically slideable, angular switch actuator 64. Beneath actuator 64 is a normally open limit switch 66 adapted to be closed as the lure car passes over actuator 64. Closing of switch 66 causes fluid to pressurize cylinder 52 and apply maximum clamping pressure on clamp members 24 and 26 for final braking.

Positioned above the track wall 12 and ahead of the braking section, FIG. 1, is the rabbit lure gate 18, provided for withdrawing the rabbit from the dogs at the conclusion of the race. Lure gate 18 is made in sections to adapt it to the track curvature. Each section is fixed to an elongated universal jointed shaft 68, FIG. 6, that is pivotally supported by frame members 70. Shaft 68 extends from the position of lure gate 18 to approximately the position of clamp member fluid cylinder 52, FIG. 1.

In this location a sprocket 72 is fixed to the shaft 68. A fluid cylinder 74 is mounted on frame 70. The piston rod of fluid cylinder 74 is connected to the sprocket 72 by means of chain 76. Energizing the piston rod end of fluid cylinder 74 pulls on chain 76, rotating sprocket 72 and raising the gate 18 to the open position shown in FIG. 6. This raised position permits the rabbit lure 16 to swing off the dog track and over the lure car rails 10 when a trip lever contacts trip 77, FIG. 1.

Figure 8:
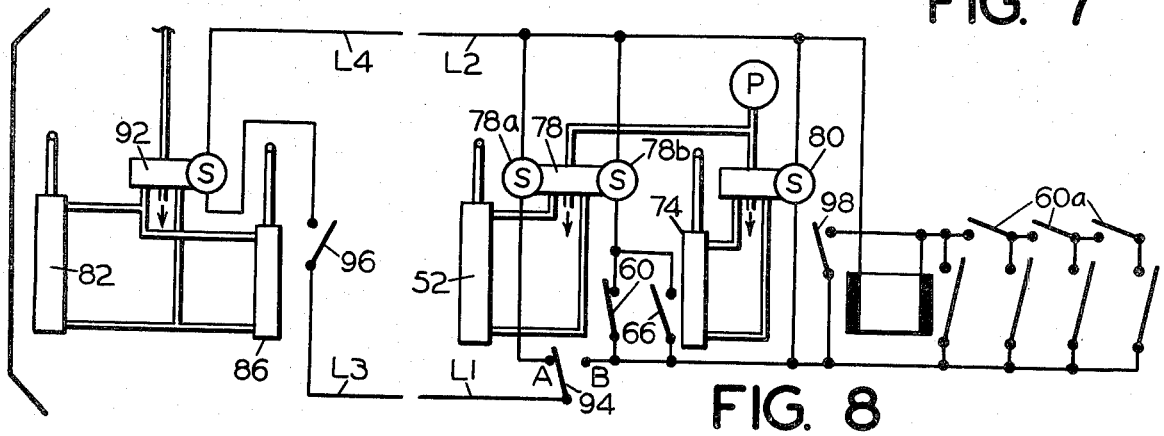
FIG. 8 is a diagrammatic and schematic layout of the control system.

Control of the fluid cylinder 52 is by a four-way double solenoid valve 78, FIG. 8 designed to pressurize both ends of the cylinder equally when the solenoids are de-energized, thereby locking the cylinder piston in a fixed position. Energizing one of the solenoids pressurizes the end of the cylinder controlled by that solenoid and releases pressure from the opposite end, thereby causing the cylinder piston to move. The control of fluid cylinder 74 is by a single solenoid four-way valve 80. The control sequence will be explained hereinafter.

To ensure maximum operating reliability, emergency drive apparatus is provided for the clamp members 24 and 26 and for opening lure gate 18.

Emergency drive apparatus for the clamp member 26 is provided by extending rod 38, FIGS. 4 and 5, past frame 54. The piston rod of fluid cylinder 82 is connected to rod 38 by chain 84. Emergency back-up for opening lure gate 18 is by a second fluid cylinder 86, FIG. 6, connected to shaft 68 by sprocket 88 and chain 90. Control of the emergency back-up cylinders 82 and 86 is by a single solenoid four-way valve 92, FIG. 8. With the solenoid of the valve de-energized the cylinders 82 and 86 are pressurized to extend the piston rods, permitting the primary apparatus to operate normally with the chains 84 and 90 becoming slack when the normally functioning cylinders 52 and 74 are pressurized to close the clamp members 24 and 26 and open lure gate 18.

OPERATION

The lure operator prepares the apparatus for operation by energizing electrical power lines L1, L2, L3 and L4, FIG. 8, with the control switch 94 in the position "A" to energize the solenoid 78*a* of valve 78 applying fluid pressure to the piston rod end of cylinder 52 opening clamp members 24 and 26. The emergency control switch 96 controlling the solenoid of valve 92 is normally open as shown, pressurizing the cylinders 82 and 86 to extend the piston rods.

With the system energized and lure gate 18 closed, the lure car is moved by the lure operator to a position ahead of the starting point for the race where the lure is extended over the track. Upon release of the race dogs at the start of the race the lure operator maintains the lure 16 a suitable distance ahead of the lead dog throughout the race.

As the dogs cross the finish line of the race the lure operator de-energizes the lure car and transfers control switch 94 to position "B" de-energizing solenoid 78*a* that has maintained clamp member 26 in an open position and energizing solenoid 78*b* applying pressure to the fluid cylinder 52 to close clamp member 26. When fluid cylinder 52 has moved rod 38 an amount sufficient to cause plate 58 to open limit switch 60 de-energizing solenoid 78*b*, valve 78 equalizes the pressure on both sides of the piston of fluid cylinder 52 locking clamp member 26 in a pre-set position to effect an initial braking as the lure car passes over clamp members 24 and 26. With control switch 94 in the "B" position the solenoid of valve 80 is also energized which pressurizes the piston rod end of cylinder 74 opening lure gate 18 and permitting lure 16 to be swung over the rails 10 to its withdrawn position of FIG. 1 as the lure car enters the braking area. As the lure car continues through the elongated length of the clamp members 24 and 26 under pre-set clamping pressure on brake shoes 22*a*, wheel 62 engages actuator 64. This closes switch 66, again energizing solenoid 78*b* and causing the cylinder 52 to apply additional clamping pressure to clamp member 26 to effect complete braking.

With the lure car stopped, the lure operator promptly resets control switch 94 to the "A" position. This de-energizes the solenoid of valve 80, applying pressure to the cylinder end of fluid cylinder 74 and permitting the lure gate 18 to fall by gravity to a closed position.

Re-setting control switch 94 to the "A" position de-energizes solenoid 78*b* and energizes solenoid 78*a*. This applies fluid pressure to the piston rod end of cylinder 52 and releases pressure from the opposite end unclamping clamp members 24 and 26. All of the events described above occur prior to the race dogs reaching the vicinity of lure gate 18.

In the event the initial transfer of the control switch 94 to the "B" position does not cause valve 78 to pre-set clamp member 26 to a pre-set position, as indicated to the operator by a sound signal resulting from de-energizing solenoid 78*b* by opening of limit switch 60, the lure operator has sufficient time to close emergency back up switch 96 which energizes the solenoid of valve 92. This applies fluid pressure to fluid cylinder 82 to close the clamp member 26 applying brake pressure to the lure car, and to cylinder 86 to open lure gate 18. Opening switch 96 closes lure gate 18 and unclamps the lure car.

In the event of rainy weather or other circumstances making braking difficult, a selected one of relay-operated limit switches 60*a* is included in the operating circuit. These switches are energized by closing preset switch 98, and are located at spaced intervals along the track to provide varying periods of brake pressure application as required to bring the car safely to a halt at the end of the race.

Having thus described the apparatus of my invention in preferred embodiments, I claim:

1. Dog track rabbit lure car braking apparatus for a lure car provided with a longitudinally arranged brake shoe, the braking apparatus comprising:

(a) laterally spaced, elongated clamp members positioned for traversal by the lure car with the brake shoe extending between the clamp members, (b) drive means connected to one of the clamp members for moving it toward and away from the other clamp member between brake shoe clamping and unclamping positions, (c) first control means for the drive means for moving said one clamp member toward said other clamp member into pre-set preliminary clamping engagement with the brake shoe to effect initial, partial braking of the lure car, and (d) second control means for the drive means operable by the lure car during said initial, partial braking for moving said one clamp member toward the other clamp member into increased clamping engagement with the brake shoe to effect final braking of the lure car.

2. The apparatus of claim 1 wherein:

(a) the drive means including (1) a double acting fluid pressure piston-cylinder unit and a source of fluid pressure therefor, (2) a first valve operable to communicate the piston-cylinder unit selectively with the fluid pressure source for moving said one clamp member away from said other clamp member, (3) a second valve operable to communicate the piston-cylinder unit selectively with the fluid pressure source for moving said one clamp member toward said other clamp member, (4) the first and second valves also being operable simultaneously to retain said one clamp member in fixed position relative to said other clamp member, and (b) the first and second control means are associated with the second valve for moving said one clamp member to said partial and final braking positions.

3. The apparatus of claim 1 wherein:

(a) the drive means includes (1) a double acting fluid pressure piston-cylinder unit and a source of fluid pressure therefor, (2) a first electric solenoid valve having an electric circuit and operable to communicate the piston-cylinder unit selectively with the fluid pressure source for moving said one clamp member away from said other clamp member, (3) a second electric solenoid valve having an electric solenoid and operable to communicate the piston-cylinder unit selectively with the fluid pressure source for moving said one clamp member toward said other clamp member, (b) the first control means includes a first electric switch in the electric circuit of the second electric solenoid valve and operable upon movement of said one clamp member to said preliminary clamping engagement to actuate the second electric solenoid valve to prevent further clamping movement of the fluid pressure unit, and (c) the second control means includes a second electric switch in the electric circuit of the second electric solenoid valve and operable by the lure car during said initial partial braking to actuate the second electric solenoid valve to effect further clamping movement of the fluid pressure unit.

4. The apparatus of claim 1 in combination with a lure gate mounted adjacent the clamp members for movement between open and closed positions and wherein the lure car mounts a lure for movement between an operative position extended outwardly of the lure gate toward the dog track and an inoperative position retracted inwardly of the lure gate, the lure gate moving means comprising drive means engaging the lure gate and operable simultaneously with the first control means to move the lure gate to open position for retraction of the lure as the lure car is subjected to said initial, partial braking.

5. The apparatus of claim 4 wherein the lure gate moving means comprises a fluid pressure piston-cylinder unit and a valve operable simultaneously with said first control means to communicate the piston-cylinder unit selectively with the fluid pressure source for moving the lure gate to open position.

* * * * *